US006565191B1

(12) United States Patent
Bolash et al.

(10) Patent No.: US 6,565,191 B1
(45) Date of Patent: May 20, 2003

(54) METHOD OF COLOR SHINGLING TO REDUCE VISIBLE PRINTING DEFECTS

(75) Inventors: John Philip Bolash, Lexington, KY (US); Michael Anthony Marra, III, Lexington, KY (US); Randall David Mayo, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/074,305

(22) Filed: Feb. 11, 2002

(51) Int. Cl.[7] ..... B41J 2/145; B41J 2/15; B41J 29/38

(52) U.S. Cl. ..... 347/40; 347/12

(58) Field of Search ..... 347/40, 12, 43, 347/37, 41

(56) References Cited

U.S. PATENT DOCUMENTS

| | | | | |
|---|---|---|---|---|
| 5,182,575 A | | 1/1993 | Kato et al. | 346/108 |
| 5,488,398 A | | 1/1996 | Matsubara et al. | 347/43 |
| 5,512,923 A | * | 4/1996 | Bauman | 347/15 |
| 5,982,990 A | * | 11/1999 | Gondek | 358/1.9 |
| 5,992,972 A | | 11/1999 | Nagoshi et al. | 347/43 |
| 6,099,104 A | | 8/2000 | Sato et al. | 347/15 |
| 6,135,656 A | | 10/2000 | Kato et al. | 400/120.15 |
| 6,142,604 A | | 11/2000 | Kanda et al. | 347/41 |
| 6,283,571 B1 | | 9/2001 | Zhou et al. | 347/15 |
| 6,293,643 B1 | | 9/2001 | Shimada et al. | 347/15 |
| 6,318,830 B1 | | 11/2001 | Sugishima | 347/12 |
| 6,318,832 B1 | | 11/2001 | Bates et al. | 347/15 |
| 6,328,395 B1 | | 12/2001 | Kitahara et al. | 347/9 |
| 6,331,040 B1 | | 12/2001 | Yonekubo et al. | 347/15 |

* cited by examiner

*Primary Examiner*—Thinh Nguyen
(74) *Attorney, Agent, or Firm*—Elizabeth C. Jacobs; Ronald K. Aust

(57) ABSTRACT

A method for reducing visual printing defects produced by an ink jet printer includes the steps of providing a first printhead nozzle array spaced apart from a second printhead nozzle array in a main scan direction; defining a plurality of rasters for scanning during a first unidirectional scan of the first printhead nozzle array and the second printhead nozzle array; and printing on a print medium with both the first printhead nozzle array and the second printhead nozzle array to form printing lines traced along at least a portion of the plurality of rasters during the first unidirectional scan, wherein the first printhead nozzle array is controlled to print in a first shingling pattern and the second printhead nozzle array is controlled to print in a second shingling pattern.

25 Claims, 6 Drawing Sheets

METHOD OF COLOR SHINGLING TO REDUCE VISIBLE PRINTING DEFECTS

BACKGROUND OF THE INVENTION

1. Field of the Invention

The present invention relates to ink jet printing, and, more particularly, to ink jet printing using color shingling to reduce visible printing defects.

2. Description of the Related Art

A typical ink jet printer forms an image on a print medium by ejecting ink from at least one ink jet printhead to form a pattern of ink dots on the print medium. Such an ink jet printer includes a reciprocating printhead carrier that transports one or more ink jet printheads across the print medium along a bi-directional scanning path defining a print zone of the printer. The bi-directional scanning path is oriented parallel to a main scan direction, also commonly referred to as the horizontal direction. The main scan direction is bi-directional. During each scan of the printhead carrier, the print medium is held stationary. An indexing mechanism is used to incrementally advance the print medium in a sheet feed direction, also commonly referred to as a sub-scan direction or vertical direction, through the print zone between scans in the main scan direction, or after all data intended to be printed with the print medium at a particular stationary position has been completed.

For a given stationary position of the print medium, printing may take place during one or more unidirectional scans of the printhead carrier. As used herein, the term "unidirectional" will be used to refer to scanning in either, but only one, of the two bi-directional scanning directions. Thus, bi-directional scanning refers to two successive unidirectional scans in opposite directions. The term "printing swath" will refer to the depositing of ink on the print medium during a particular unidirectional scan of the printhead carrier at which time individual printhead nozzles of the printhead are selectively actuated to expel ink. A printing swath is made of a plurality of printing lines traced along imaginary rasters, the imaginary rasters being spaced apart in the sheet feed direction.

Typically, each ink jet printhead will include a plurality of ink jet nozzles for expelling the ink. In ink jet printing, it is common to use the ink colors of cyan, magenta, yellow and black in generating color prints. Also, it is common in ink jet printing to have a single printhead having a dedicated nozzle array for each of cyan, magenta and yellow inks, respectively, wherein the three nozzle arrays are aligned vertically, that is, aligned in a direction parallel to the sub-scan direction.

In order to form the pattern of ink drops on the print medium, a rectilinear array, also known as rectilinear grid, of possible pixel locations is defined within the printable boundaries of the print medium. The center-to-center distance between pixels, sometimes referred to as dot pitch, is determined by the resolution of the printer. For example, in a printer capable of printing 600 dots per inch (dpi), the dot pitch of the array is one six-hundredth of an inch. The horizontal lines of the rectilinear array are the rasters, as introduced above.

The quality of printed images produced by an ink jet printer depends in part on the resolution of the printer. Typically, higher or finer resolutions, where the printed dots are more closely spaced, results in higher quality images. Increasing the resolution of an ink jet printer increases the number of dots to be printed in a unit area by the product of the increase factor in each dimension in the grid. For example, doubling the print resolution from 300 to 600 dpi in a rectilinear grid results in four times as many dots per unit area.

Printing quality using an ink jet printer of the type described above can be further improved by using a technique commonly referred to as shingling, or interlaced printing, wherein consecutive printing swaths are made to overlap. For example, in one known shingling mode using 50% shingling, approximately 50% of the dots for a particular color are placed on any given pass of the printhead, thereby requiring two passes of the printhead to completely print. The candidate dots of the first pass of the printhead are selected according to a checkerboard pattern. The remaining 50% of the dots are placed on a subsequent pass of the printhead.

When printing with an ink jet printer using a shingling method as described above, it is known to assign a particular interlace level to a tri-color printhead for use during printing on the print medium. For example, assuming that an image area corresponds to 16 rasters, it is known to assign a single interlace level for each of the cyan array of ink jetting orifices, magenta array of ink jetting orifices and yellow array of ink jetting orifices. It is also known to change the interlace level between portions of the image area which are spaced apart in the advance direction of the print medium. Finally, when using an ink jet printer having both a tri-color printhead and a black printhead, it is known to print using one interlace level for the tri-color printhead and a different or no interlace level for the black printhead. A selected one of a plurality of interlace levels may be used to effectively reduce a print artifact in a particular portion of an image area. For example, a 50% shingling technique (2 pass shingling) may be used to reduce a print artifact in one portion of the image area, while a 33% shingling technique (3 pass shingling) may be used to reduce a print artifact in a different part of the image area. Conventional methods of shingling would thus select the more restrictive 33% interlace level (3 pass shingling) for both portions of the image area so that all print artifacts are reduced. This may not be optimum from an efficiency standpoint in terms of throughput of the printer.

Traditional ink jet printers are designed to slightly underfeed the print medium in the sheet feed direction, essentially indexing a small amount short of the ideal index distance. This is done to hide indexing errors due to the mechanical system tolerances, as well as the algorithm used to control the indexing motion. The theory behind this approach is that a gap, observed as a white space on white paper, between consecutively printing swaths, due to a slight overfeed error, is more visible to the user than a slightly darker line due to an underfeed.

However, when shingling is employed, the errors due to purposeful underfeed can accumulate within a printed region, causing undesirable print defects. For example, a 0.15 percent underfeed using a printhead having 160 color nozzles having a nozzle pitch of one six-hundredth of an inch can yield a dot placement error just due to underfeed of around 10 micrometers. While this error is typically acceptable for single pass modes, where a 10 micrometers underfeed is desirable to mask other indexing errors, in shingled modes a print quality degradation is evident.

What is needed in the art is a printing method that reduces the visual print defects due to an underfeeding of the print medium.

SUMMARY OF THE INVENTION

The present invention reduces visual print defects, such as those occurring during ink jet printing due to an underfeeding of the print medium.

The invention, in one form thereof, relates to a method for reducing visual printing defects produced by an ink jet printer. The ink jet printer includes a reciprocating carrier that carries a first printhead nozzle array and a second printhead nozzle array along a bi-directional scanning path. The method includes the steps of providing the first printhead nozzle array spaced apart from the second printhead nozzle array in a main scan direction; defining a plurality of rasters for scanning during a first unidirectional scan of the first printhead nozzle array and the second printhead nozzle array; and printing on a print medium with both the first printhead nozzle array and the second printhead nozzle array to form printing lines traced along at least a portion of the plurality of rasters during the first unidirectional scan, wherein the first printhead nozzle array is controlled to print in a first shingling pattern during the first unidirectional scan and the second printhead nozzle array is controlled to print in a second shingling pattern during the first unidirectional scan.

In another form thereof, the present invention relates to an ink jet printer for printing on a print medium sheet. The ink jet printer has a printhead carriage unit including a reciprocating carrier that travels along a bi-directional scanning path in a main scan direction. A first printhead nozzle array is coupled to the carrier. A second printhead nozzle array is coupled to the carrier, the second printhead nozzle array being spaced apart from the first printhead nozzle array in the main scan direction. A controller is communicatively coupled to each of the printhead carriage unit, the first printhead nozzle array and the second printhead nozzle array. The controller executes instructions to effect printing on the print medium sheet during a first unidirectional scan of the carrier with both the first printhead nozzle array and the second printhead nozzle array to form printing lines traced along a plurality of rasters during the first unidirectional scan, wherein the first printhead nozzle array is controlled to print in a first shingling pattern during the first unidirectional scan and the second printhead nozzle array is controlled to print in a second shingling pattern during the first unidirectional scan.

In still another form thereof, the invention relates to a method of printing with an ink jet printer including a reciprocating carrier that carries a first printhead and a second printhead along a bi-directional scanning path. The method includes the steps of defining a raster corresponding to a print line to be printed on a print medium; scanning the first printhead and the second printhead across the print medium along the raster in a first unidirectional pass along the bi-directional scanning path; actuating the first printhead during the first unidirectional pass to selectively eject a first plurality of ink drops of a first color on the print medium along the raster to form a first plurality of ink dots of the print line; and actuating the second printhead during the first unidirectional pass to selectively eject a second plurality of ink drops of a second color, different from the first color, on the print medium along the raster to from a second plurality of ink dots of the print line, the first plurality of ink dots being interspersed with the second plurality of ink dots.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION OF THE INVENTION

Figure 1:
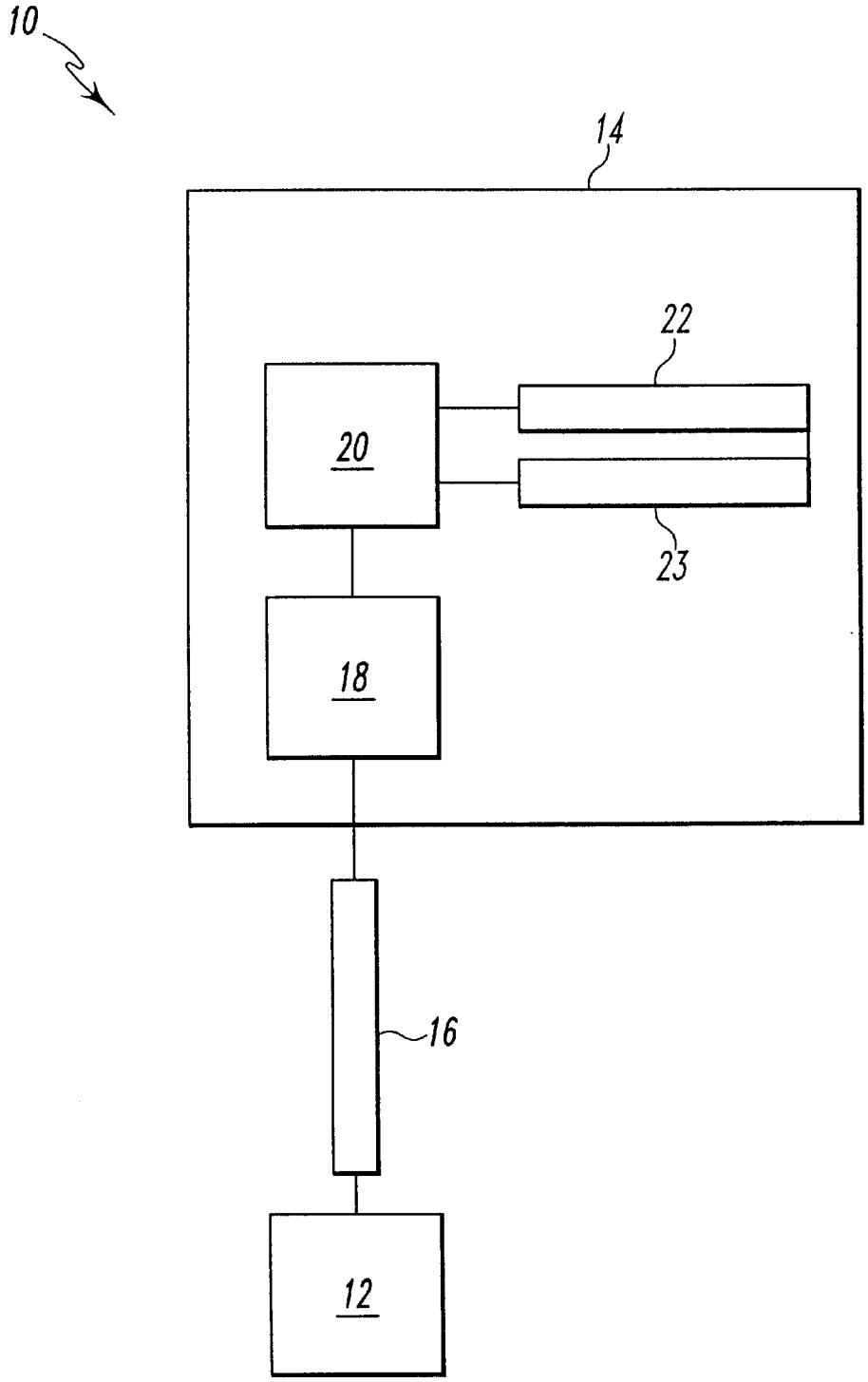
FIG. 1 is a block diagram of an ink jet printer incorporating the present invention.

Referring now to the drawings and particularly to FIG. 1, there is shown a schematic view of an ink jet printing system 10 including a host computer 12 and an ink jet printer 14. Host computer 12 is coupled to ink jet printer 14 via a bi-directional communications link 16. Communications link 16 can be effected, for example, using point-to-point electrical cable connections between serial or parallel ports of ink jet printer 14 and host computer 12, using an infrared transceiver unit at each of ink jet printer 14 and host computer 12, or via a network connection, such as an Ethernet network. Host computer 12 includes application software operated by a user, and provides image data representing an image to be printed, and printing command data, to ink jet printer 14 via communications link 16. During bi-directional communications, ink jet printer 14 supplies printer information, such as for example printer status and diagnostics information, to host computer 12 via communications link 16.

As shown schematically in FIG. 1, ink jet printer 14 includes a data buffer 18, a controller 20, a printhead carriage unit 22 and a print media sheet feed unit 23. The printing command data and image data received by ink jet printer 14 from host computer 12 are temporarily stored in data buffer 18. Controller 20, which includes a microprocessor with associated random access memory (RAM) and read only memory (ROM), executes program instructions to retrieve the print command data and printing data from data buffer 18, and processes the printing command data and image data. From the printing command data and the image data, controller 20 executes further instructions to effect the generation of control signals which are supplied to printhead carriage unit 22 and print media sheet feed unit 23 to effect the printing of an the image on a print medium sheet, such as paper. The image data supplied by host computer 12 to ink jet printer 14 may be in a bit image format, wherein each bit of data corresponds to the placement of an ink dot of a particular color of ink at a particular pixel location in a rectilinear grid of possible pixel locations.

Figure 2:
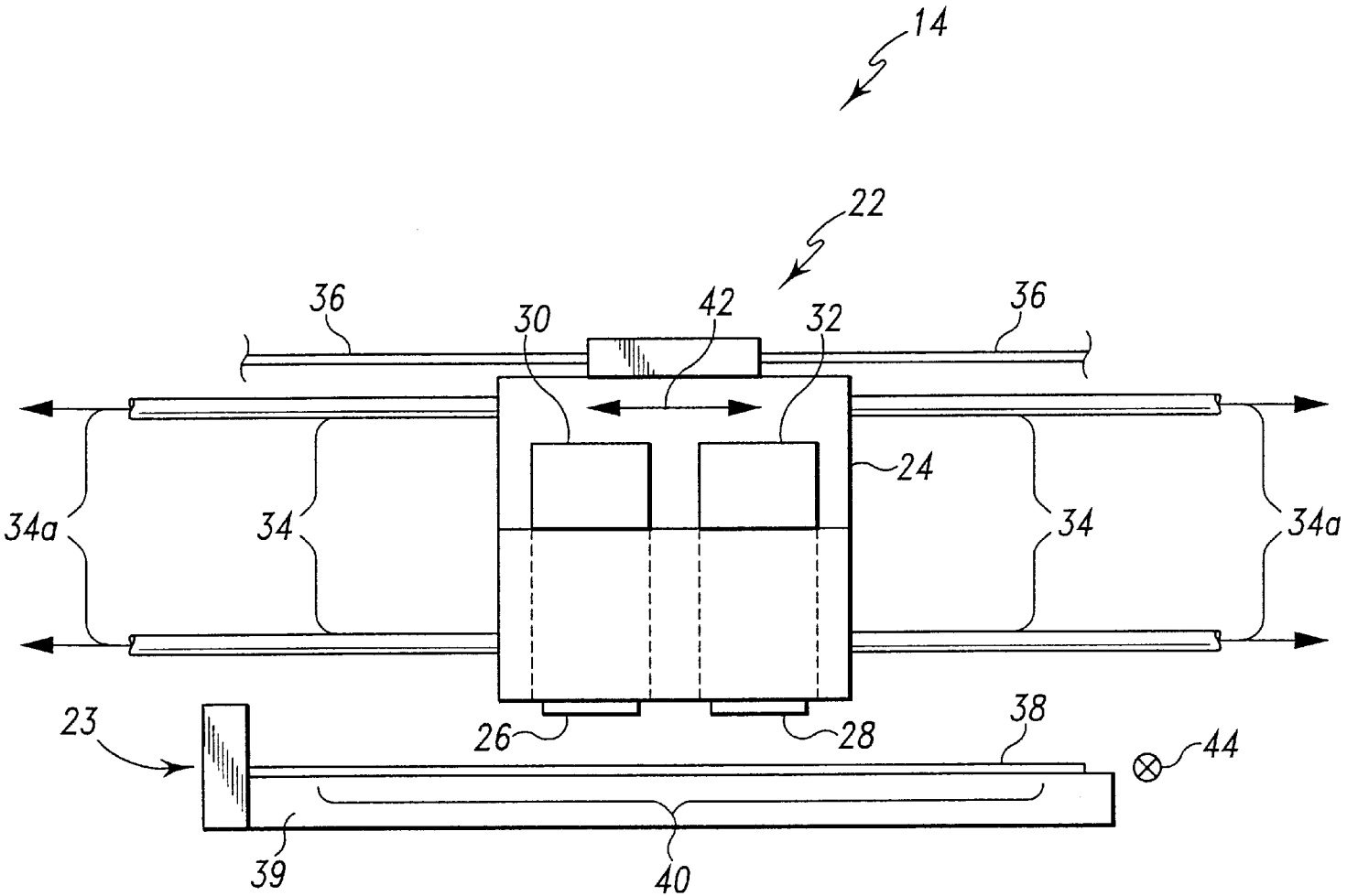
FIG. 2 is a front view of a portion of the ink jet printer of FIG. 1.

Referring to FIG. 2, printhead carriage unit 22 includes a printhead carrier 24 for carrying a color printhead 26 and a black printhead 28. A color ink reservoir 30 is provided in fluid communication with color printhead 26, and a black ink reservoir 32 is provided in fluid communication with black printhead 28.

Printhead carrier 24 is guided by a pair of guide rods 34. The axes 34*a* of guide rods 34 define a bi-directional scanning path for printhead carrier 24, and thus, for convenience the bi-directional scanning path will be referred to as bi-directional scanning path 34*a*. Printhead carrier 24 is connected to a carrier transport belt 36 that is driven by a carrier motor (not shown) to transport printhead carrier 24 in a reciprocating manner along guide rods 34. Thus, the reciprocation of printhead carrier 24 transports ink jet printheads 26, 28 across a print medium sheet 38, such as paper, along bi-directional scanning path 34*a* to define a print zone 40 of ink jet printer 14. This reciprocation occurs in a main scan direction 42 that is parallel with bi-directional scanning path 34*a*, and is also commonly referred to as the horizontal direction. During each scan of printhead carrier 24, print medium sheet 38 is held stationary by print media sheet feed unit 23. Print media sheet feed unit 23 includes an index roller 39 that incrementally advances the print medium sheet 38 in a sheet feed direction 44, also commonly referred to as a sub-scan direction or vertical direction, through print zone 40. As shown in FIG. 2, sheet feed direction 44 is depicted as an X within a circle to indicate that the sheet feed direction is in a direction perpendicular to the plane of FIG. 2, toward the reader. Sheet feed direction 44 is substantially perpendicular to main scan direction 42, and in turn, substantially perpendicular to bi-directional scanning path 34*a*. Printhead carriage unit 24 and printheads 26, 28 may be configured for unidirectional printing or bi-directional printing.

Depending upon the particular design of ink jet printer 14, color ink reservoir 30 may be fixedly attached to color printhead 26 so as to form a unitary color printhead cartridge. Alternatively, color ink reservoir 30 may be removably attached to color printhead 26 so as to permit the replacement of color ink reservoir 30 separate from the replacement of color printhead 26, and in this alternative color ink reservoir 30 is located on-carrier in close proximity to color printhead 26. In another alternative, color ink reservoir 30 may be located off-carrier at a location remote from color printhead 26.

Likewise, black ink reservoir 32 may be fixedly attached to black printhead 28 so as to form a unitary black printhead cartridge. Alternatively, black ink reservoir 32 may be removably attached to black printhead 28 so as to permit the replacement of black ink reservoir 32 separate from the replacement of black printhead 28, and in this alternative black ink reservoir 32 is located on-carrier in close proximity to black printhead 28. In another alternative, black ink reservoir 32 may be located off-carrier at a location remote from black printhead 28.

Figure 3:
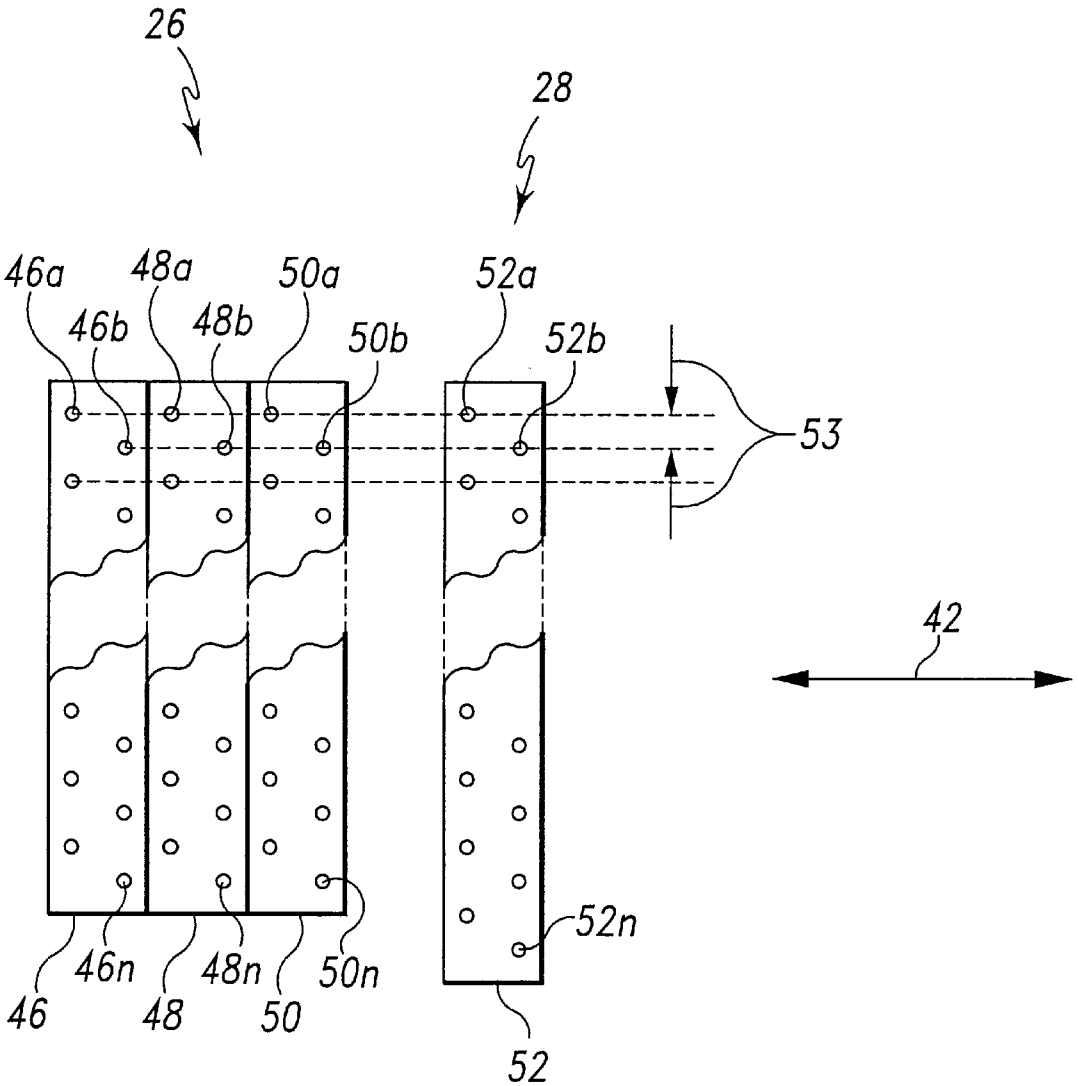
FIG. 3 is a plane view of a plurality of printhead nozzle arrays.

Referring to FIG. 3, color printhead 26 includes three printhead nozzle arrays 46, 48, and 50, and black printhead 28 includes a printhead nozzle array 52. As shown in FIG. 3, each of nozzle arrays 46, 48, 50, 52 includes a plurality of ink jetting nozzles, 46*a*–46*n*, 48*a*–48*n*, 50*a*–50*n* and 52*a*–52*n*, respectively. Such nozzles are sometimes also referred to as orifices. In the embodiment shown, the three printhead nozzle arrays 46, 48, and 50 will sometimes be referred to as cyan nozzle array 46, magenta nozzle array 48 and yellow nozzle array 50, although it is to be understood that other colors could be associated with printhead nozzle arrays 46, 48, and 50. Also, it is contemplated that printhead nozzle arrays 46, 48, and 50 can be formed as three nozzle arrays in a single printhead, or as individual printhead nozzle arrays in three different printheads. Each nozzle of the plurality of ink jetting nozzles 46*a*–46*n*, 48*a*–48*n*, 50*a*–50*n* and 52*a*–52*n* individually has an associated actuator, such as a heater element or a piezoelectric element, which, when energized at the directive of controller 20, causes an ink drop to be expelled from the nozzle. Thus, each ink jetting nozzle 46*a*–46*n*, 48*a*–48*n*, 50*a*–50*n* and 52*a*–52*n* of each of printhead nozzle arrays 46, 48, 50, 52 can be individually and selectively actuated by controller 20 to expel an ink drop to form a corresponding ink dot on print medium sheet 38.

As shown in FIG. 3, the plurality of ink jetting nozzles in each of nozzle arrays 46, 48, 50, 52 are disposed in a staggered and horizontally adjacent relationship relative to each other. In the embodiment shown, a vertical nozzle spacing 53 between two consecutive staggered nozzles is one six-hundredth of an inch, thereby permitting 600 dpi printing with no level of interlaced printing. The top-most ink jetting nozzles 46*a*, 48*a*, 50*a* of color printhead 26 are positioned in horizontal alignment so that, when color printhead 26 is installed in printhead carrier 24, ink jetting nozzles 46*a*, 48*a*, 50*a* will travel along the bi-directional scanning path 34*a* parallel to main scan direction 42 and trace along the same raster and print along the same printing line. The same relationship holds true for orifices 46*b*–*n*, 48*b*–*n* and 50*b*–*n*, respectively.

When printheads 26, 28 are installed in printhead carrier 24, printhead nozzle arrays 46, 48 and 50 will be positioned in carrier 24 in relation to the position of printhead nozzle array 52, such that certain color nozzles of the color printhead 26 will trace the same raster as would the horizontally aligned black nozzle of black printhead 28. However, since printhead nozzle array 52 is vertically taller than printhead nozzle arrays 46, 48 and 50, there is not a mutual one-to-one correspondence between the color and black nozzles for the full height of printhead nozzle array 52. It will be appreciated that the number of ink emitting orifices within each printhead nozzle array 46, 48, 50, 52 may vary from that shown, and the physical position of the cyan, yellow and magenta nozzle arrays 46, 48 and 50 relative to each other may vary without departing from the scope of the invention, so long as at least some of the nozzles in two or more of the color nozzle arrays 46, 48 and 50 are in horizontal alignment.

Figure 4:
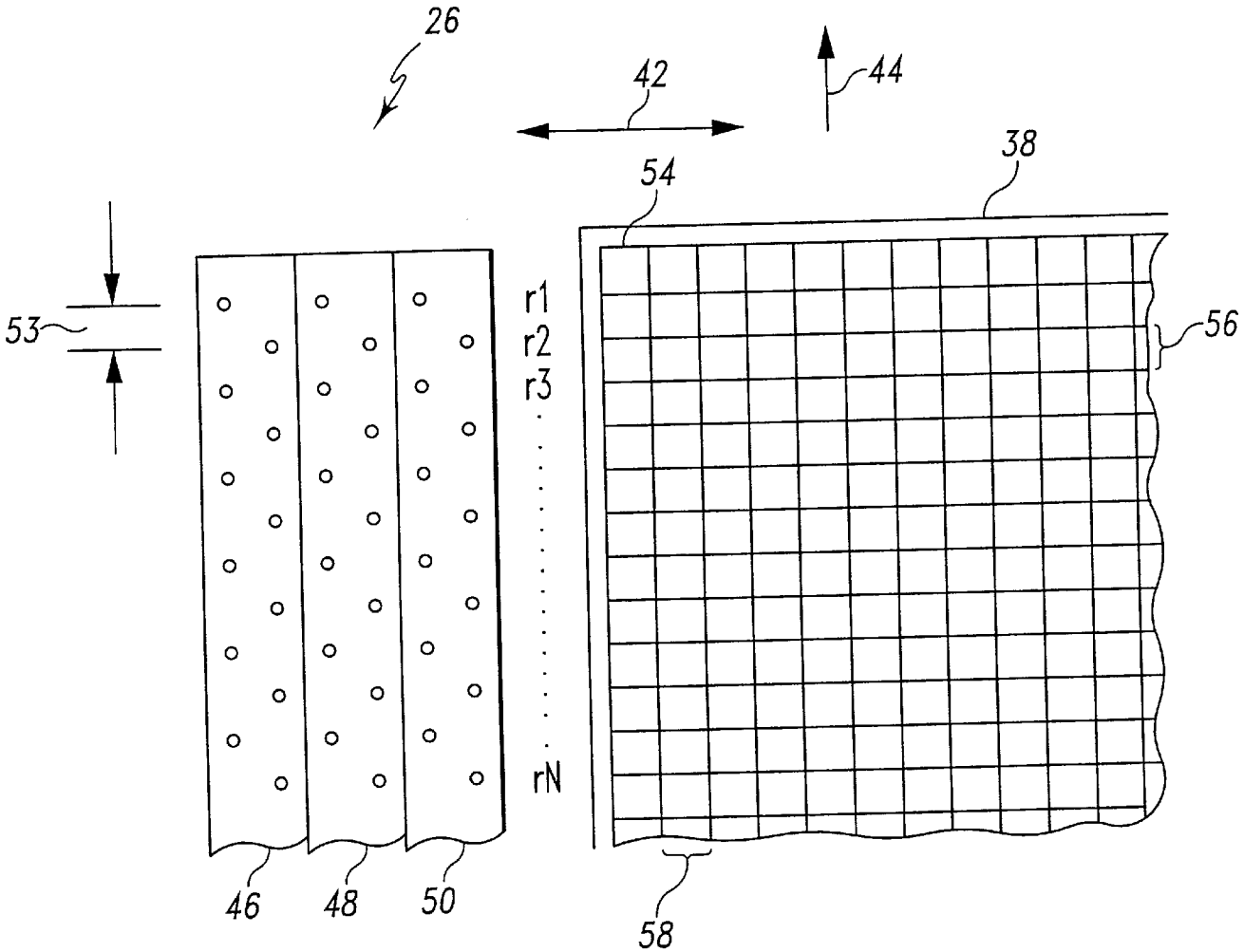
FIG. 4 is a schematic illustration of the relationship between individual nozzles of the plurality of printhead nozzle arrays and a rectilinear grid.

Referring to FIG. 4, there is shown print medium sheet 38 which is overlaid by an imaginary rectilinear grid 54 of possible pixel locations defined within the printable boundaries of print medium sheet 38, those locations being where ink dots ideally are to be formed. Rectilinear grid 54 includes a plurality of pixel rows (rasters) and pixel columns defining the printable image area on print medium sheet 38. The pixel rows are arranged to be horizontally parallel, and parallel with the main scan direction 42. Each pixel row, i.e., each raster, will correspond to a potential printing line on print medium sheet 38. The center-to-center distance between pixels, sometimes referred to as dot pitch, is determined by the resolution of the printer. In the described embodiment, the dot pitch, and the vertical distance between the centerlines of two adjacent rasters, can be for example, one six-hundredth of an inch, and as such, the raster spacing 56 between adjacent pairs of the plurality of rasters r1–rN is one six-hundredth of an inch. As indicated above, the closest vertical nozzle spacing 53 for each of nozzle arrays 46, 48, 50 and 52 can also be, for example, one six-hundredth of an inch. The horizontal pixel spacing 58 between adjacent pairs of pixels along the horizontal extent of rasters r1–rN may also be selected to be one six-hundredth of an inch. It is to be understood however, that raster spacing 56 and horizontal pixel spacing 58 need not be equal, and can have values other than one six-hundredth of an inch.

During operation, printer controller 20 executes instructions to effect the shingling method of the present invention in order to reduce visual printing defects produced by an ink jet printer, and particularly those printing defects attributable to a print medium underfeed situation. The general steps of the shingling method of the present invention are outlined in FIG. 5, and exemplary printing results are shown in FIG. 6, and alternatively, in FIG. 7.

Figure 5:
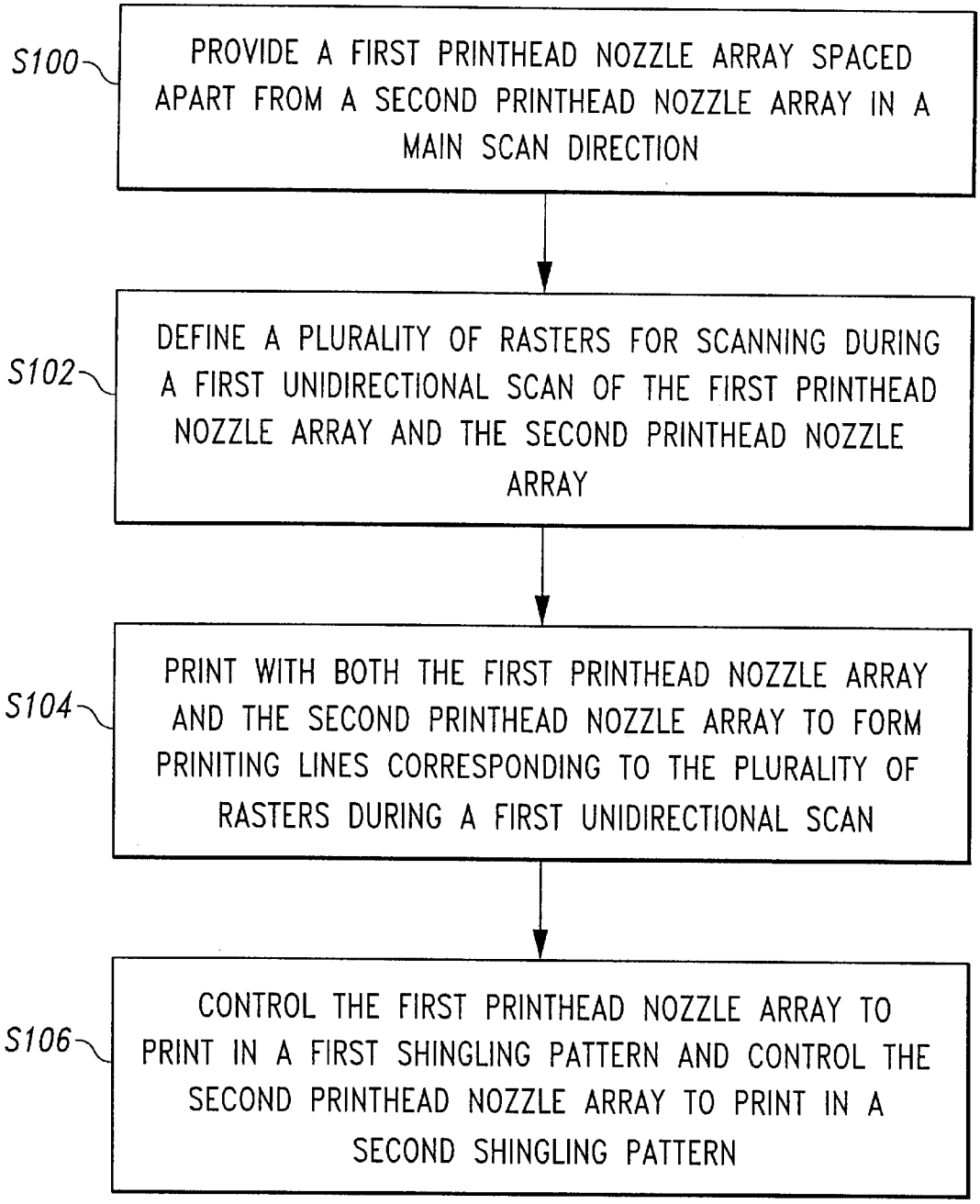
FIG. 5 is a general flow chart used to describe a method of the present invention.

At step S100 of FIG. 5, and as shown in FIGS. 3 and 4, color printhead nozzle arrays 46, 48 and 50 are spaced apart in the horizontal direction from each other in main scan direction 42. At step S102, print controller 20 defines the size, location and the spacings 56, 58 for rectilinear grid 54, including defining the plurality of rasters r1–rN for scanning during a first unidirectional scan of printhead nozzle arrays 46, 48 and 50. At step S104, during the first unidirectional scan, printhead carrier 24 (see FIG. 2) is moved, for example, from left to right (or alternatively, from right to left), and the ink jetting nozzles of a first printhead nozzle array, such as printhead nozzle array 46, and of a second printhead nozzle array, such as printhead nozzle array 48, are actuated to print ink dots on print medium sheet 38 to form printing lines corresponding to at least a portion, for example the plurality of rasters r1–r3, of the plurality of rasters r1–rN during the first unidirectional scan of printhead carrier 24. During this same unidirectional scan, as indicated at step S106, the first printhead nozzle array is controlled to print in a first shingling pattern and the second printhead nozzle array is controlled to print in a second shingling pattern. In a preferred embodiment, controller 20 controls printhead nozzle array 46 to print cyan ink in the first shingling pattern and controls printhead nozzle array 48 to print magenta ink the second shingling pattern, during the same unidirectional scan.

Figure 6:
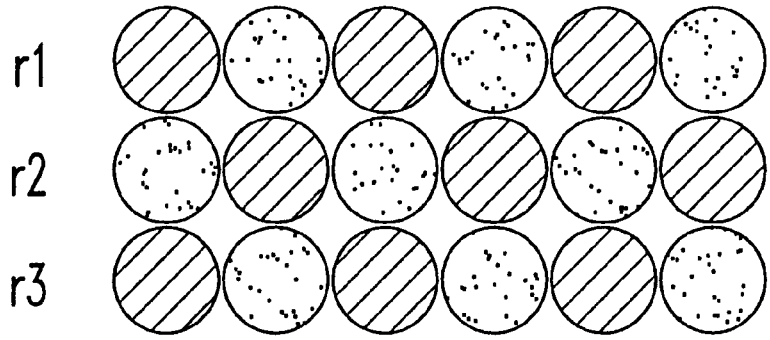
FIG. 6 shows an example of the color shingling method of the present invention when forming ink drops of substantially equal size.
Figure 7:
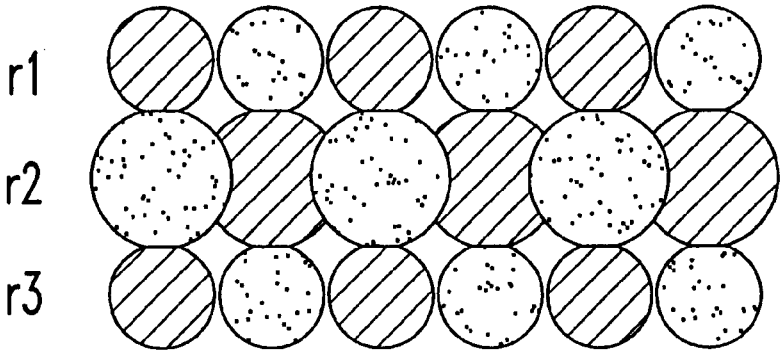
FIG. 7 shows an example of the color shingling method of the present invention when forming ink drops of at least two different sizes.

FIGS. 6 and 7 show exemplary printed outputs using the shingling method of present invention. A first color of ink is depicted by a circle with dots, and a second color of ink is depicted by a circle with several diagonal lines running therethrough. In the example that follows, the first color of ink can be, for example a cyan ink or a yellow ink, and the second color of ink can be, for example, a magenta ink.

In FIG. 5, the first shingling pattern, for example a shingling pattern for the cyan ink, is selected to be a 50 percent lattice pattern. A lattice pattern is also known as a checker-board pattern. The second shingling pattern, for example a single pattern for the magenta ink, is also selected to be a 50 percent lattice pattern. However, the two lattice patterns are positioned to be offset (thus being complementary) in at least the main scan direction, i.e., in the horizontal dimension of the rectilinear grid 54 of FIG. 4. In other words, the second lattice pattern overlays the first lattice pattern to fill the pixel gaps between the pixel locations associated with the first lattice pattern.

Referring to FIG. 6, in the case of two offset lattice shingling patterns, and assuming that a solid band of color is to be printed on print medium sheet 38 to form printed lines corresponding to rasters r1, r2, and r3, each printing line would receive an alternating pattern of cyan ink dots and magenta ink dots in the horizontal direction during a single scan, in other words during one unidirectional scan, of printhead carrier 24 across print medium sheet 38. Thus, in this embodiment the two shingling patterns are selected to avoid printing at the same pixel location along the plurality of rasters r1–r3 during the formation of the print lines corresponding to rasters r1–r3 during the single unidirectional scan.

It is to be understood that other ink color combinations, such as yellow and magenta, could be selected for use with the two shingling patterns, such as the offset lattice shingling patterns described above. Further, it is contemplated that on a single unidirectional pass, that either or both of cyan and yellow can be printed on, for example, the even pixel locations and magenta would be printed on the odd pixel locations.

FIG. 7 shows the results of using the method of the invention where each of the cyan printhead nozzle array 46, magenta printhead nozzle array 48 and yellow printhead nozzle array 50 includes two sizes of nozzles, simply referred to herein as large and small, wherein (with reference to FIG. 3) the right column of nozzles are large nozzles and the left column of nozzles are small nozzles. As shown, in a single pass, i.e., one unidirectional scan, small ink drops are formed on the odd rasters ri and r3, and the large ink drops are formed on the even raster r2, and both the magenta ink drops, and one or both of cyan and yellow ink drops, are printed using the complementary shingle pattern described above.

As shown in FIGS. 6 and 7, by using complementary lattice shingling patterns, an alternating pattern of magenta ink drops and, cyan and/or yellow, ink drops are printed along rasters r1, r2, and r3.

To be complete, in a 50 percent shingling mode a second unidirectional pass, for example the return pass of the first unidirectional pass, is used to print the remaining data. As such, each pixel location in rectilinear grid 54 will have had the opportunity to receive all possible combinations of cyan, magenta and yellow ink colorants in two passes of printhead carrier 24. In order for each pixel location to have the opportunity to receive, in addition to all possible combinations of cyan, magenta and yellow ink colorants, both large and small dots of these inks (see FIG. 7), then four pass shingling would be employed.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for reducing visual printing defects produced by an ink jet printer including a reciprocating carrier that carries a first printhead nozzle array and a second printhead nozzle array along a bi-directional scanning path, comprising the steps of:

providing said first printhead nozzle array spaced apart from said second printhead nozzle array in a main scan direction;

defining a plurality of rasters for scanning during a first unidirectional scan of said first printhead nozzle array and said second printhead nozzle array; and printing on a print medium with both said first printhead nozzle array and said second printhead nozzle array to form printing lines traced along at least a portion of said plurality of rasters during said first unidirectional scan, wherein said first printhead nozzle array is controlled to print in a first shingling pattern during said first unidirectional scan and said second printhead nozzle array is controlled to print in a second shingling pattern during said first unidirectional scan.

2. The method of claim 1, wherein said first printhead nozzle array ejects a first color of ink and said second printhead nozzle array ejects a second color of ink.

3. The method of claim 2, wherein said first color of ink is one of a cyan ink and a yellow ink, and said second color of ink is a magenta ink.

4. The method of claim 1, wherein said first shingling pattern and said second shingling pattern are printed on said print medium during said first unidirectional scan in an alternating pattern of ink dots of a first color and ink dots of a second color traced along said at least a portion of said plurality of rasters, said first color being different from said second color.

5. The method of claim 4, wherein said first printhead nozzle array ejects ink drops of said first color and said second printhead nozzle array ejects ink drops of said second color ink.

6. The method of claim 5, wherein said first color is one of cyan and yellow, and said second color is magenta.

7. The method of claim 1, wherein each of said first shingling pattern and said second shingling pattern is a lattice pattern, and wherein said first shingling pattern is offset from said second shingling pattern at least in said main scan direction.

8. The method of claim 7, wherein said first printhead nozzle array ejects a first color of ink and said second printhead nozzle array ejects a second color of ink, said first color of ink being different from said second color of ink.

9. The method of claim 8, wherein said first color of ink is one of a cyan ink and a yellow ink, and said second color of ink is a magenta ink.

10. The method of claim 1, wherein said first shingling pattern and said second shingling pattern are selected to avoid printing at a same pixel location along said plurality of rasters during said first unidirectional scan.

11. The method of claim 10, wherein said first printhead nozzle array ejects a first color of ink in said first shingling pattern and said second printhead nozzle array ejects a second color ink in said second shingling pattern.

12. The method of claim 11, wherein said first color of ink is one of a cyan ink and a yellow ink, and said second color of ink is a magenta ink.

13. An ink jet printer for printing on a print medium sheet, comprising:

a printhead carriage unit including a reciprocating carrier that travels along a bi-directional scanning path in a main scan direction;

a first printhead nozzle array coupled to said carrier;

a second printhead nozzle array coupled to said carrier, said second printhead nozzle array being spaced apart from said first printhead nozzle array in said main scan direction; and a controller communicatively coupled to each of said printhead carriage unit, said first printhead nozzle array and said second printhead nozzle array, said controller executing instructions to effect printing on said print medium sheet during a first unidirectional scan of said carrier with both said first printhead nozzle array and said second printhead nozzle array to form printing lines traced along a plurality of rasters during said first unidirectional scan, wherein said first printhead nozzle array is controlled to print in a first shingling pattern during said first unidirectional scan and said second printhead nozzle array is controlled to print in a second shingling pattern during said first unidirectional scan.

14. The ink jet printer of claim 13, wherein said first printhead nozzle array ejects a first color of ink and said second printhead nozzle array ejects a second color of ink.

15. The method of claim 14, wherein said first color of ink is one of a cyan ink and a yellow ink, and said second color of ink is a magenta ink.

16. The ink jet printer of claim 13, wherein said first shingling pattern and said second shingling pattern are printed on said print medium sheet during said first unidirectional scan in an alternating pattern of ink dots of a first color and ink dots of a second color traced along at least one of said plurality of rasters.

17. The ink jet printer of claim 16, wherein said first printhead nozzle array ejects ink drops of said first color and said second printhead nozzle array ejects ink drops of said second color.

18. The method of claim 17, wherein said first color is one of cyan and yellow, and said second color is magenta.

19. The ink jet printer of claim 13, wherein each of said first shingling pattern and said second shingling pattern is a lattice pattern, and wherein said first shingling pattern is offset from said second shingling pattern at least in said main scan direction.

20. The ink jet printer of claim 19, wherein said first printhead nozzle array ejects a first color of ink and said second printhead nozzle array ejects a second color of ink, different from said first color of ink.

21. The ink jet printer of claim 20, wherein said first color of ink is a cyan ink and said second color of ink is a magenta ink.

22. A method of printing with an ink jet printer including a reciprocating carrier that carries a first printhead and a second printhead along a bi-directional scanning path, and a mechanism for incrementally advancing a print medium in a feed direction that is substantially perpendicular to said bi-directional scanning path, said method comprising the steps of:

defining a raster corresponding to a print line to be printed on said print medium;

scanning said first printhead and said second printhead across said print medium along said raster in a first unidirectional pass along said bi-directional scanning path;

actuating said first printhead during said first unidirectional pass to selectively eject a first plurality of ink drops of a first color on said print medium along said raster to form a first plurality of ink dots of said print line; and actuating said second printhead during said first unidirectional pass to selectively eject a second plurality of ink drops of a second color, different from said first color, on said print medium along said raster to form a second plurality of ink dots of said print line, said first plurality of ink dots being interspersed with said second plurality of ink dots.

23. The method of claim 22, wherein said first color is one of cyan and yellow, and said second color is magenta.

24. The method of claim 22, wherein said first plurality of ink dots is interspersed with said second plurality of ink dots to form an alternating pattern of said first plurality of ink dots and said second plurality of ink dots.

25. The method of claim 24, wherein said first color is one of cyan and yellow, and said second color is magenta.

* * * * *